United States Patent [19]

Terauchi et al.

[11] Patent Number: 4,820,907

[45] Date of Patent: Apr. 11, 1989

[54] CONTROLLED FURNACE HEAT TREATMENT

[75] Inventors: Kenichi Terauchi; Takeo Okamoto, both of Hazukashi, Japan

[73] Assignee: Dainippon Screen Mfg. Co., Ltd., Kyoto, Japan

[21] Appl. No.: 131,634

[22] Filed: Dec. 11, 1987

[30] Foreign Application Priority Data

Dec. 11, 1986 [JP] Japan ..... 61-296131

[51] Int. Cl.[4] ..... H05B 1/02

[52] U.S. Cl. ..... 219/494; 219/121.43; 219/491; 219/508; 432/34

[58] Field of Search ..... 219/494, 121.43, 501, 219/497, 491, 490, 509, 210, 211, 521, 508, 411–414; 156/345, 627; 427/8, 10; 432/34

[56] References Cited

U.S. PATENT DOCUMENTS

| | | | |
|---|---|---|---|
| 2,969,471 | 1/1961 | Schneider | 219/210 |
| 3,883,715 | 5/1975 | Gebo | 219/210 |
| 4,586,006 | 4/1986 | Emmons | 219/210 |
| 4,593,258 | 6/1986 | Block | 310/176 |
| 4,684,783 | 8/1987 | Gore | 219/210 |

FOREIGN PATENT DOCUMENTS

| | | |
|---|---|---|
| 60-37116 | 2/1985 | Japan . |
| 62-67813 | 3/1987 | Japan . |

*Primary Examiner*—M. H. Paschall

*Attorney, Agent, or Firm*—Lowe, Price, LeBlanc, Becker & Shur

[57] ABSTRACT

The present invention is directed to a heat treatment apparatus for performing heat treatment of a substrate. According to the present invention, a thermocouple is introduced into a heating furnace and discharged from the heating furnace by carrier means in such a state that one side ends of the wires forming thermocouple are connected to the substrate and another ends of the wires forming the thermocouple are connected to fixed terminals of a terminal mount. Movable terminals of a terminal driving mechanism are brought into contact with the fixed terminals of the terminal mount, to outwardly extract output signals of the thermocouple. Thus, temperatures of the temperature measuring substrate can be accurately measured while securing air-tightness in the heating furnace. Further, entanglement of metal wires forming the thermocouple is prevented in introduction/discharging of the substrate.

8 Claims, 3 Drawing Sheets

CONTROLLED FURNACE HEAT TREATMENT

BACKGROUND OF THE INVENTION

1. Field of the Invention

The present invention relates to a heat treatment apparatus for performing heat treatment of various substrates such as a semiconductor wafer, a ferrite substrate for magnetic recording and the like by heating means, and more particularly, it relates to a heat treatment apparatus which measures the temperature of a substrate under heating on the basis of output signals from thermocouple mounted on the substrate.

2. Description of the Prior Art

In a conventional heat treatment apparatus for thermally treating a substrate such as a semiconductor wafer by heating means, control data for driving the heating means, i.e., the so-called profile data, are previously stored in a memory. In order to thermally treat the treated substrate by such a heat treatment apparatus, the heating means is controlled by a computer on the basis of the profile data so that heat treatment is executed by a required temperature program for the treated substrate. In order to create the profile data in the heat treatment apparatus, a temperature measuring substrate is independently prepared by the same material with the treated substrate. A thermocouple is mounted on the temperature measuring substrate, which in turn is contained in a heating furnace and appropriately heated, to measure surface temperatures of the substrate from hour to hour on the basis of output signals from the thermocouple, thereby to obtain data required for creating the profile data.

In such a heat treatment apparatus, heat treatment of the treated substrate is generally executed by closing the door of the heating furnace to bring the furnace into an airtight state and maintaining the furnace under a vacuum or required gas atmosphere. In order to create profile data of high accuracy, therefore, it is also necessary in temperature measurement of the temperature measuring substrate contained in the heating furnace to bring the furnace into an airtight state, thereby to keep the furnace in the same condition as that for heat treatment of the treated substrate. However, when temperature measurement of the temperature measuring substrate as hereinabove described, it is necessary to extract two types of metal wires forming the thermocouple from the furnace to obtain output signals from the thermocouple. Such metal wires have generally been extracted from a clearance formed by slightly opening the door of the heating furnace, whereby air-tightness in the furnace is deteriorated and correct data cannot be obtained.

As a method of extracting the two types of metal wires forming the thermocouple from the furnace while securing air-tightness in the furnace, a wire hole may be provided in a furnace wall portion to pass the metal wires through the wire hole. In such a method, however, it is necessary to once draw out ends of the two types of metal wires, being previously passed in the furnace through the wire hole, from an inlet of the heating furnace to connect the same to the temperature measuring substrate and thereafter contain the metal wires again in the furnace with the temperature measuring substrate. Thus, the metal wires of the thermocouple may loosen when the temperature measuring substrate is introduced into the furnace, to be entangled with each other. Such entanglement of the metal wires may also take place when the temperature measuring substrate is extracted from the furnace. Probability of such entanglement of the metal wires is increased particularly when a plurality of thermocouples are mounted on the temperature measuring substrate in order to measure surface temperature distribution of the temperature measuring substrate.

SUMMARY OF THE INVENTION

The present invention is directed to a heat treatment apparatus for performing heat treatment of a substrate.

The heat treatment apparatus according to the present invention comprises a heating furnace having an inlet/output port; a heat source for heating the interior of the heating furnace; a door mounted on the inlet/outlet port for the substrate; a thermocouple consisting of two types of metal wires and having a common contact point, which is formed by connecting one side ends of the metal wires, being fixed to the substrate; a terminal mount provided with fixed terminals in correspondence to the metal wires of the thermocouple another side ends of the metal wires of the thermocouple being connected to the fixed terminals respectively; carrier means for introducing the substrate, the thermocouple and the terminal mount, being coupled with each other, into a prescribed position in the heating furnace through the inlet/outlet port and discharging the same from the prescribed position in the heating furnace; and a terminal driving mechanism provided with movable terminals in correspondence to the fixed terminals and mounted on a furnace wall portion of the heating furnace, which terminal driving mechanism retains the movable terminals reciprocatably against the heating furnace to be freely in contact with/separated from the fixed terminals contained in the prescribed position of the heating furnace thereby to extract output signals of the thermocouple from the movable terminals.

Accordingly, a principal object of the present invention is to provide a heat treatment apparatus which can accurately measure a temperature of a substrate contained in a heating furnace by a thermocouple mounted on the substrate while securing air-tightness in the heating furnace.

Another object of the present invention is to provide a heat treatment apparatus in which the metal wires forming the thermocouple can be prevented from entanglement with each other in introduction/discharging of the substrate into/from the heating furnace.

According to the present invention, movable terminals are moved by a terminal driving mechanism to positions separated from fixed terminals, so that a substrate, a thermocouple and a terminal mount, which are coupled with each other, can be introduced into and discharged from a heating furnace by carrier means. For temperature measurement, the movable terminals are brought into contact with the fixed terminals by the terminal driving mechanism to extract output signals from the thermocouple. Thus, a temperature of the substrate contained in the heating furnace can be accurately measured by the thermocouple while securing air-tightness in the heating furnace. Further, the metal wires forming the thermocouple can be prevented from entanglement in introduction/discharging of the substrate into/from the heating furnace.

These and other objects, features, aspects and advantages of the present invention will become more apparent from the following detailed description of the present invention when taken in conjunction with the accompanying drawings.

DESCRIPTION OF THE PREFERRED EMBODIMENT

Figure 1:
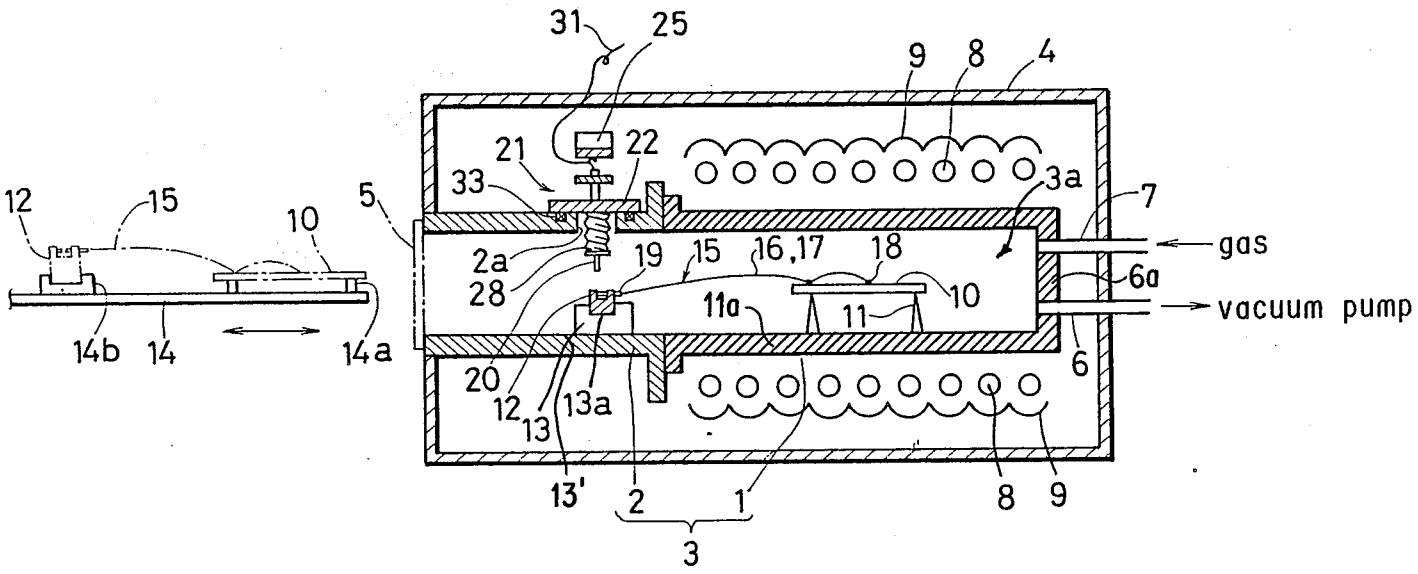
FIG. 1 is a schematic sectional view showing a heat treatment apparatus according to an embodiment of the present invention.

The heat treatment apparatus comprises a heating furnace 3 which consists of a chamber 1 of quartz forming a heat treatment chamber and another chamber 2 forming a front chamber, and the heating furnace 3 is mounted in a body case 4. A door 5 is mounted on a substrate inlet/outlet port, which is an entrance to the heating furnace 3, and the door 5 is closed to maintain the interior 3a of the heating furnace 3 in an airtight state with respect to the exterior. The heating furnace 3 is provided in a rear furnace wall portion ba thereof with an air suction path 6 which communicates with a vacuum pump for decompressing the furnace interior 3a and a gas supply path 7 for supplying required gas to the furnace interior 3a. Heating light sources 8 such as halogen lamps are oppositely arranged above and below the chamber 1, and reflecting plates 9 are provided at the back of the heating light sources 8. A pair of supports 11 are provided on a bottom furnace wall portion 11a of the chamber 1 for supporting a substrate such as a semiconductor wafer 10, while a pair of supports 13 each having a receiving cavity 13a in its upper surface are provided in a bottom furnace wall portion 13 of the chamber 2 for supporting a terminal mount 12. Such a pair of supports 11 are provided at regular intervals perpendicularly to the plane of FIG. 1, thereby to form a space for allowing insertion of a carrier arm 14 between the supports 11 and 11. Similary, a pair of supports 13 are provided at regular intervals perpendicularly to the plane of FIG. 1, thereby to from a space for allowing insertion of a carrier arm 14 between the supports 13 and 13.

Figure 2:
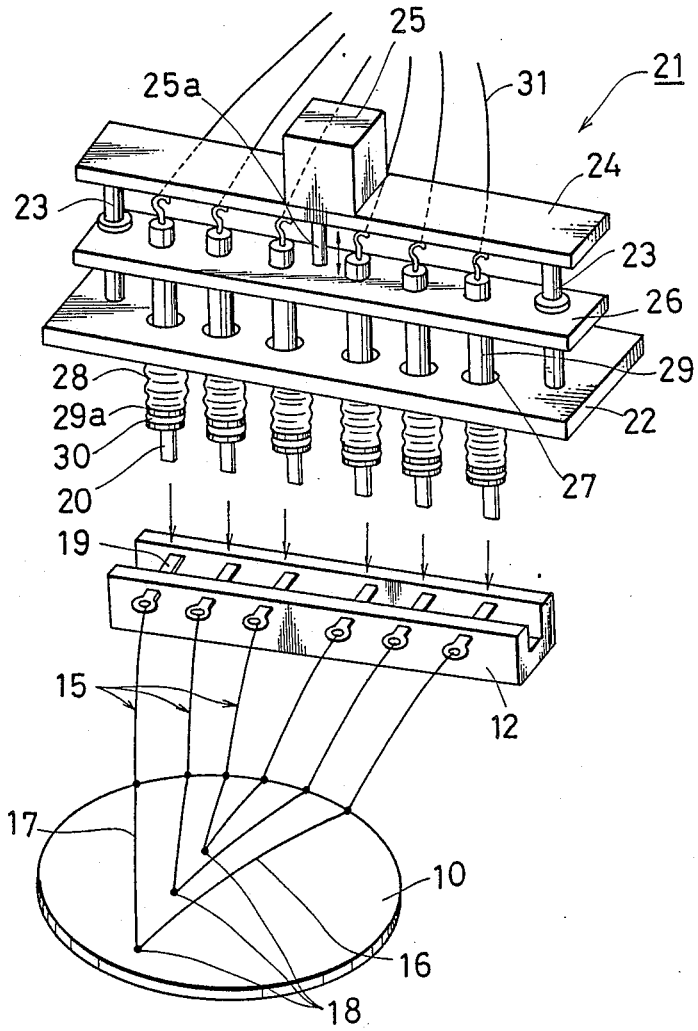
FIG. 2 is a perspective view showing a terminal mount to which thermocouples are connected and a terminal driving mechanism.

The temperature measuring wafer 10 is prepared by the same material with a treated wafer, and thermocouples 15 are mounted on the treated wafer. As shown in FIG. 2, each of the thermocouples 15 is formed by two types of metal wires 16 and 17 such as chromel wire and alumel wire, and common contact points 18 formed by connecting one side ends of the metal wires 16 and 17 to desired temperature measuring points on the wafer surface. In this embodiment, three such thermocouples 15 are provided to measure surface temperature distribution of the wafer 10, and the respective common contact points 18 are fixed to different positions on the wafer surface. However, the number of the thermocouples 15 is not particularly restricted, but at least a single thermocouple 15 may be provided. The metal wires 16 and 17 of the thermocouples 15, being prevented from mutual contact, are fixed to the peripheral edge portion of the wafer 10 in appropriate intermediate portions of the metal wires 16 and 17, while another ends thereof are connected to fixed terminals 19 provided on the terminal mount 12. The fixed terminals 19 are provided in correspondence in number to the metal wires 16 and 17 of the thermocouples 15, and arranged across a groove portion of the terminal mount 12, which has a groove shape, at regular intervals along a longitudinal direction of the terminal mount 12. The fixed terminals 19 are preferably formed by the same material with the metal wires 16 or 17 connected to the fixed terminals 19.

Figure 3:
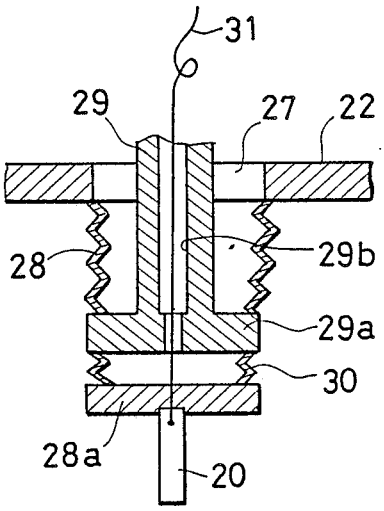
FIG. 3 is a partial sectional view of the terminal driving mechanism.

Above the supports 13 (FIG. 1) for supporting the terminal mount 12, a terminal driving mechanism 21 for reciprocatably driving movable terminals 20 toward the furnace interior 3a is mounted on a top furnace wall portion of the chamber 2. As shown in FIG. 2, the terminal driving mechanism 21 has a mounting plate 22 fixed to the top furnace wall portion of the chamber 2 and a cylinder mount 24 provided above the mounting plate 22 through a pair of guide bars 23. A cylinder 25 is mounted on a central position of the cylinder mount 24, while a piston rod 25a of the cylinder 25 is coupled to an elevating plate 26 which is guided by the guide bars 23 for upward/downward movement, thereby to upwardly/downwardly move the elevating plate 26 by the cylinder 25. Six rod insertion holes 27 are provided in the mounting plate 22 in correspondence to the fixed terminals 19, and upper ends of metal bellows 28 are coupled to the lower surface of the mounting plate 22 to enclose the rod insertion holes 27 as shown in FIG. 3. Pipe-shaped elevating rods 29 are provided to pass through the rod insertion holes 27, so that flange portions 29a in the lower ends of elevating rods 29 are airtightly coupled to the upper ends of the metal bellows 28 while the upper ends of elevating rods 29 are fixed to the elevating plate 26 to pass through the same, as shown in FIG. 2. Below the flange portions 29a of the elevating rods 29, lower end blocking plates 28a are mounted through metal bellows 30, so that the movable terminals 20 are mounted on the lower end blocking plates 28a. The metal bellows 30 function as compression springs for applying contact pressure between the movable terminals 20 and the fixed terminals 19. The movable terminals 20 are connected with metal wires 31, which pass through wire insertion holes 29b in the elevating rods 29 to be drawn out from upper openings of the elevating rods 29, thereby to be guided to a thermocouple temperature measuring part provided in the exterior of the body case 4. The cylinder 25 of the terminal driving mechanism 21 is reciprocatably driven so that the elevating rods 29 are moved up/down through the elevating plate 26 and the metal bellows 28 are contracted/expanded to upwardly/downwardly drive the movable terminals 20. The terminal driving mechanism 21 is mounted by forming an opening 2a in the top furnace wall portion of the chamber 2 as shown in FIG. 1 and arranging the metal bellows 28 to be contained in the opening 2a, thereby to fix the peripheral edge portion of the mounting plate 22 to an upper opening edge portion of the chamber 2. In this case, the terminal driving mechanism 21 is provided in such a position that the movable terminals 20 can be brought into contact with the corresponding fixed terminals 19 when the movable terminals 20 are downwardly driven by the cylinder 25. The movable terminals 20 and the metal wires 31 connected with the same are preferably formed by the same material with the corresponding fixed terminals 19.

On the other hand, the carrier arm 14, which serves as carrier means for introducing/discharging the temperature measuring wafer 10 and the terminal mount 12 into/from the heating furnace 3, has supports 14a and 14b for supporting the temperature measuring wafer 10 and the terminal mount 12. The distance between the supports 14a and the supports 14b is set to be equal to the distance between the supports 11 and the supports 13.

In order to create profile data, temperature measurement of the temperature measuring wafer 10 is performed by the aforementioned heat treatment apparatus as follows: First, the temperature measuring wafer 10 and the terminal mount 12 interconnected by the thermocouples 15 are placed on the supports 14a and 14b of the carrier arm 14 in the exterior of the heating furnace 3 as shown by phantom lines in FIG. 1, and thereafter the temperature measuring wafer 10 and the terminal mount 12 are introduced into the heating furnace 3 by the carrier arm 14, to be placed on the supports 11 and the supports 13. Then the cylinder 25 of the terminal driving mechanism 21 is driven to downwardly move the movable terminals 20, thereby to bring the movaable terminals 20 into contact with the corresponding fixed terminals 19. Thus, the thermocouples 15 mounted on the temperature measuring wafer 10 are connected to the thermocouple temperature measuring part through the fixed terminals 19, the movable terminals 20 and the metal wires 31, to enable temperature measurement of the wafer 10. Thereafter the door 5 is closed to bring the furnace interior 3a in an airtight state, and the light sources 8 are turned on to heat the wafer 10 while evacuating the furnace interior 3a or supplying required gas to the furnace interior 3a at need, thereby to measure temperatures of the wafer 10 through the thermocouple temperature measuring part from hour to hour by employing output signals from the thermocouples 15. After the temperature measurement is completed, the wafer 10 and the terminal mount 12 are discharged in a procedure reverse to the above. Namely, the movabl terminals 20 are upwardly moved by the cylinder 25 of the terminal driving mechanism 21 to be separated from the fixed terminals 19, and the door 5 is opened to discharge the wafer 10 and the terminal mount 12 from the heating furnace 3 by the carrier arm 14.

Thus, the metal wires 16 and 17 of the thermocouples 15 mounted on the wafer 10 are connected to the fixed terminals 19 of the terminal mount 12 while the movable terminals 20 of the terminal driving mechanism 21 are brought into contact with the fixed terminals 19 to outwardly extract the output signals of the thermocouples 15, whereby the temperatures of the wafer 10 can be measured by the thermocouples 15 while closing the door 5 to maintain sufficient air-tightness in the furnace interior 3a. Further, since the wafer 10 provided with the thermocouples 15 is introduced/discharged with the terminal mount 12 into/from the heating furnace 3 by the carrier arm 14, the metal wires 16 and 17 of the thermocouples 15 will not be entangled with each other in introduction/discharging thereof.

Although the terminal driving mechanism 21 is mounted on the top furnace wall portion of the chamber 2 in the above embodiment, the same may be mounted on the bottom furnace wall portion of the chamber 2. In this case, the terminal mount 12 may be placed on the supports 13 so that the fixed terminals 19 will be downwardly directed to face the movable terminals 20. Further, although temperature measurement of the wafer 10 is performed by the thermocouples 15 in the above embodiment, the thermocouples 15 may be adapted to measure temperatures of various substrates other than wafers. In addition, although the heating light sources 8 are employed as heat sources in the above embodiment, other heat sources may be employed.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A heat treatment apparatus for performing heat treatment of a substrate, comprising:

a heating furnace having an inlet/outlet port means for transferring said substrate into and out of the furnace;

a heat source for heating said heating furnace;

(a) door means mounted on said inlet/outlet port means for opening and closing said heating furnace;

a thermocouple including two types of metal wires having a common contact point formed by respectively connecting first ends of said two types of metal wires to said substrate;

a terminal mount provided with fixed terminals in correspondence to said metal wires of said thermocouple, ends of said two types of metal wires of said thermocouple opposite said first ends being respectively connected to said fixed terminals;

carrier means for introducing said substrate, said thermocouple and said terminal mount, being coupled with each other, into a prescribed position in said heating furnace through said inlet/outlet port means and discharging said substrate, said thermocouple and said terminal mount, being coupled with each other, from said prescribed position in said heating furnace; and a terminal driving mechanism provided with movable terminals in correspondence to said fixed terminals and mounted on a furnace wall portion of said heating furnace, said terminal driving mechanism retaining said movable terminals in selective contact with said fixed terminals contained in said prescribed position of said heating furnace to thereby extract output signals of said thermocouple from said movable terminals.

2. A heat treatment apparatus in accordance with claim 1, wherein said movable terminals are reciprocatably driven into and out of contact with said fixed terminals by a cylinder.

3. A heat treatment apparatus in accordance with claim 1, wherein a plurality of thermocouples are mounted on said substrate and pluralities of pairs of fixed terminals and movable terminals are provided in correspondence to said plurality of thermocouples.

4. A heat treatment apparatus in accordance with claim 1, wherein said terminal driving mechanism is provided in a top furnace wall portion of said heating furnace.

5. A heat treatment apparatus in accordance with claim 1, wherein said terminal driving mechanism is provided on a bottom furnace wall portion of said heating furnace.

6. The heat treatment apparatus of claim 1, wherein said terminal driving mechanism includes mounting plate means mounted to said furnace wall portion, said movable terminal being respectively mounted to lower ends of a plurality of rods movably mounted within holes formed in said mounting plate, said rods being formed with internal passageways extending therethrough respectively containing wires for electrically connecting the movable terminals to transmit said output signals from the thermocouple.

7. The heat treatment apparatus of claim 6, further including bellow means extending between said mounting plate and said rods to respectively seal said openings in the mounting plate through which said rods extend.

8. A heat treatment apparatus for performing heat treatment of a substrate, comprising:

a heating furnace having an inlet/outlet port means for transferring said substrate into and out of the furnace;

a heat source for heating said heating furnace;

door means mounted on said inlet/outlet port means for opening and closing said heating furnace;

temperature measuring means for measuring the temperature of the substrate;

a terminal mount provided with fixed terminals connected to the temperature measuring means;

carrier means for introducing said substrate, said temperature measuring means and said terminal mount, being coupled with each other, into a prescribed position in said heating furnace through said inlet/outlet port means and discharging said substrate, said temperature measuring means and said terminal mount, being coupled with each other, from said prescribed position in said heating furnace; and a terminal driving mechanism provided with movable terminals in correspondence to said fixed terminals and mounted on a furnace wall portion of said heating furnace, said terminal driving mechanism retaining said movable terminals in selective contact with said fixed terminals contained in said prescribed position of said heating furnace to thereby extract output signals of said temperature measuring means from said movable terminals.

* * * * *